US005360258A

United States Patent [19]

Alivizatos

[11] Patent Number: 5,360,258

[45] Date of Patent: Nov. 1, 1994

[54] PORTABLE SINGLE AND MULTIPLE UNIT BABY SUPPORT SEAT

[75] Inventor: Margaret A. Alivizatos, Dallas, Tex.

[73] Assignee: Maurice Adam, Dallas, Tex.

[21] Appl. No.: 818,068

[22] Filed: Jan. 7, 1992

[51] Int. Cl.[5] ..... A47C 7/16

[52] U.S. Cl. ..... 297/440.11; 297/184.13; 297/DIG. 11

[58] Field of Search ..... 297/250, 296, 440, 441, 297/443, 184, 250.1, 440.1, 440.11, 440.2, 440.22, 184.1, 184.13, DIG. 11

[56] References Cited

U.S. PATENT DOCUMENTS

| | | | |
|---|---|---|---|
| 2,365,003 | 12/1944 | Reinholz | 297/250 X |
| 2,509,451 | 5/1950 | Reinholz | 297/440 X |
| 3,050,280 | 8/1962 | Regan | 297/184 X |
| 3,110,519 | 11/1963 | Chernivsky | 297/285 |
| 3,235,306 | 2/1966 | Chernivsky | 297/296 |
| 3,719,389 | 3/1973 | Burton et al. | 297/440 |
| 4,914,772 | 4/1990 | Difloe | 297/422 X |

*Primary Examiner*—Kenneth J. Dorner
*Assistant Examiner*—Milton Nelson, Jr.
*Attorney, Agent, or Firm*—Harris, Tucker & Hardin

[57] ABSTRACT

A single, dual or multiple portable baby support seat is made from mostly interchangeable components of commonly available and inexpensive materials. A frame is formed from two or more spaced apart upright frame members in side-by-side arrangement, the frame members having a base leg for resting on a surface, a support leg raised over the base leg for defining the edge of a baby holding unit and supporting a unit fabric support member, the support leg being supported through an intermediate curved leg connected to the base leg. The frame members are held in side-by-side upright position by transverse members connecting the distal ends through elbow-like or T-like connectors. The connectors are at least partially disconnectable and rotatable with respect to the frame members so that the frame members may be folded flat for transportation or storage. An open mesh, non-absorbent, non-slip fabric forms the fabric support member and includes a strap to secure a baby. The fabric is cool, easily washed and removable from the frame. The frame is adapted to flexibly provide a soothing, gentle bouncing motion in response to natural movements of a baby positioned on the unit. The baby is firmly held in a central pocket supported by the fabric without being in contact with any hard parts of the frame.

20 Claims, 5 Drawing Sheets

FIG. 8
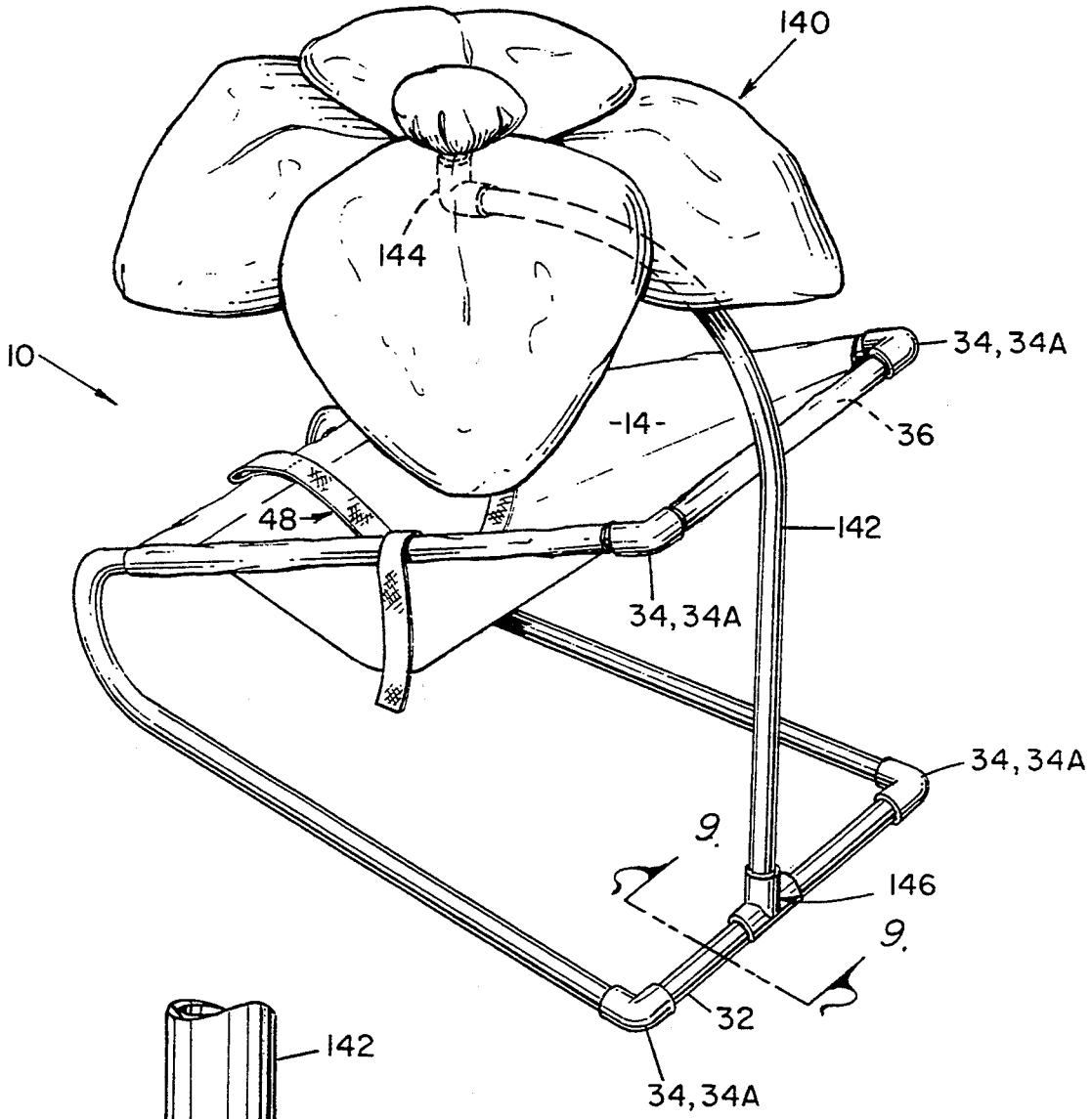
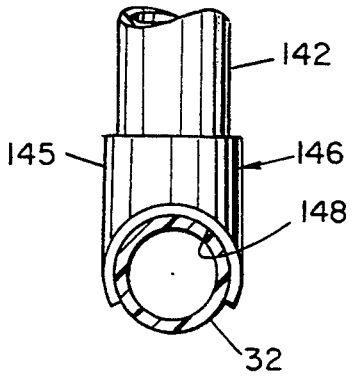
FIG. 9

PORTABLE SINGLE AND MULTIPLE UNIT BABY SUPPORT SEAT

BACKGROUND OF THE INVENTION

1.Field of the Invention

The invention pertains to single and multiple baby supporting devices which are conveniently foldable for transportation and which provide a soothing gentle bouncing motion in response to a baby's natural movements.

2. Background of the Prior Art.

The prior art has various types of car seats and stationary seats which include fabric or padded portions on which the baby or child is positioned including some which have a wire frame having a certain amount of deflection under load. Applicant believes all of them have certain disadvantages in terms of use and in terms of construction which adversely impact their use. None of them are designed to accommodate more than a single infant at a time as they are not made in dual or multiple units for twins or triplets or multiple infants. Although some of the prior art designed seats can be said to come apart, they come apart in several pieces and require time consuming disassembly such that the users are discouraged from disassembling them for the purpose of transporting them to other places. Materials cost tends to be high because of specialized components or injection molding in the case of plastic. The units are commonly made from wire frames or other metal frames and are relatively heavy. Where fabric seat portions are used, the fabric must be provided in multiple layers to have sufficient strength and anti-slip surface characteristics are not generally provided. The use of nonstandard materials adds substantially to the cost. Few of them can successfully be washed without disassembly. Competitive items made of metal or molded soft plastic tend to be hard and require extensive cushioning so that the baby does not contact anything hard.

It would be desirable to provide an inexpensive baby support seat using common components to provide not only single units but also units designed to support twins or triplets, for example. It would be desirable to provide such units with a single layer of non-absorbent mesh fabric which breathes and which has superior wash-up and quick drying characteristics. An anti-slip surface is desirable to keep the baby from sliding and a deep pocket to hold the baby would be desirable for similar reasons.

Of particular importance would be the ability to provide a single or multiple unit which is made from inexpensive, common materials for reduced cost and which is easily and quickly foldable into a flat orientation for taking on trips and easily reassembled without nuts, bolts, and screws. It is further desirable to produce a unit having non-heat conductive plastic parts and one which is more comfortable for the baby. The unit should have a bouncing action which is activated by a baby's movements. These features, in various combinations, are not found in prior art devices.

SUMMARY OF THE INVENTION

A portable baby support seat is disclosed which is made of common elements which are combinable as single, dual or multiple units upon which one or more babies may be placed. The single unit has a frame having a pair of spaced apart side members which comprise a straight base leg, a reverse curved front leg and a generally straight support leg supported by the base leg through the curved leg. The side members have an upright orientation with a generally lower transverse leg connecting the distal ends of the base legs. The generally straight support leg is preferably angled upwardly to where the distal ends are connected through a transverse upper leg which is removable. The transverse upper leg may be disconnected to install and replace a fabric support member which has a central baby supporting area when it is installed in supported position on the straight support legs of the side members.

With the transverse upper leg removed to expose the distal ends of the straight support legs of the spaced apart side members, a fabric support member is installed having elongated side pocket means or loops on either side of the baby supporting area for receiving support on each side from one of the generally straight support legs of the pairs of side members. The fabric support may also include an upper pocket means at the uppermost end of the fabric support member oriented generally transversely to the side pocket means, for receiving support from a transverse upper leg which keeps the fabric support member from sliding with respect to the side members. The frame is constructed from materials selected to flexibly provide a gentle bouncing motion in response to the ordinary movements of a baby when a baby is located on the supporting area of the fabric support member, mounted on the frame.

The unit may be folded flat provided at least one connection between the base legs and the lower transverse leg is separable and the other connections are rotatably disengageable by loosening and rotating so that the frame members are foldable toward each other in a flat orientation. This can be done with all the parts still attached without having loose separate pieces to keep track of. Simple elbow-like friction fit connectors may be used for this purpose. The fabric support member is preferably an open mesh non-absorbent coated fabric based on scrim. The frame support members are preferably made from hollow plastic tubing bent to shape. A deepened central pocket area and straps on the fabric support member may be used to secure a baby on the seat and a non-slip surface on the fabric helps prevent the baby from slipping.

In a further embodiment, a portable dual baby support seat has a frame having a central support member positioned between a pair of spaced apart side support members, each having an underleg and an overleg connected by an intermediate curved leg portion and arranged for resting on a surface with the overlegs suspended over the respective underlegs of each frame support member. Distal end portions of the frame underlegs are connected to a backleg support member extending from the central underleg transversely to either side and connected to the distal ends of the underlegs of the side support members. Similarly, distal end portions of the frame overlegs of the support members are connected to an upperleg support member extending from the central overleg transversely to either side and connected to the distal ends of the overlegs of the side support members.

A fabric support member is supported on the overlegs of the frame. The fabric support member may have elongated side pocket means on either side for receiving support from one overleg of the side support member on either side and having an elongated central pocket means for receiving support from the overleg of the central support member. The fabric support may include an upper support means arranged at a top end to receive support from the upperleg support member extending transversely to either side of the central overleg.

A pair of central baby supporting areas centered on each side between the elongated central pocket means and the elongated side pocket means provides dual baby supporting areas on either side of the central frame member when the fabric support member is mounted on the frame. The frame is adapted to flexibly provide a gentle bouncing motion in response to the movements of at least one baby positioned on a baby supporting area of the fabric support member by selection of the material and geometry of the frame supporting members.

The connections of the backleg support member and the upperleg support member are wholly or partly rotatably releasable so that the central support member and the pair of spaced apart side support members can be folded into a flat orientation for being transported from place to place. The fabric support member is preferably an open mesh fabric having a non-absorbent, non-slip surface and including a significant central pocket for biasly supporting a baby in the central pocket area on either side of the central support member. Strap means may be used to further secure a baby in the significant central pocket areas. The distal ends of the central support member may be connected to the upperleg and backleg support members by means of T-shaped connectors, and the distal ends of the side support members may be connected to the backleg and upperleg support members by means of elbow-like connectors, at least some of the connectors being completely disconnectable for the purpose of aiding the folding of the frame central and side support members into a flat orientation. The fabric support cover is preferably arranged to be removable from the upper transverse support member and the upperleg support members so that it may be washed or cleaned apart from the frame members.

In a further embodiment, a multiple baby support seat has a frame formed from a plurality of spaced apart upright frame members in side-by-side arrangement comprising two outside frame members and one or more inside frame members spaced together and connected together to form the frame. The frame members have a base leg for resting on a surface, a support leg raised over the base leg for defining the edge of the baby holding unit and supporting a unit fabric support cover, the support leg of each frame member being supported through an intermediate curved leg joined to the base leg.

One or more first transverse members extend from one outside frame member to the other outside frame member and connect to the distal ends of their base legs including connections at spaced apart distal ends of the base legs of the inside support members.

The raised up support legs have spaced apart successive side-to-side outside, inside and outside support members which define the edges of individual baby supporting units and have distal ends which are connected by one or more second transverse members in spaced apart orientation. The one or more second transverse members extend from one outside frame member to the other outside frame member and connect to the distal ends of their support legs, including connections at spaced apart distal ends of the support legs of the inside support members.

The connections between the distal ends of the frame members and said one or more first and second transverse members are preferably disconnectable and reconnectable so that the frame may be disassembler and folded flat for transport. A plurality of unit fabric support covers which may be joined are supported by the support legs of the frame members and secured in unit position by securing means to provide baby holding support areas between adjacent support members. The frame similarly provides gentle bouncing motion in response to natural movements of one or more babies being located in one or more of the baby holding units on the unit fabric support covers, the material and size of the frame members being adapted to flex perceptibly in response to a baby's movements.

The unit fabric support cover is preferably unitary with looped portions which slide over the respective frame member support legs and is removable therefrom when the distal ends of the frame members are exposed by removal of said one or more second transverse members so that the fabric support cover may be removed for washing and cleaning. The fabric support cover is preferably an open mesh non-absorbent, non-slip material based on scrim, which is easily washed without becoming wet. It can be washed while on the frame without disassembly of the unit. Strap members on the fabric support covers may be employed to help secure a baby in place.

A separable decorative cover is provided which may provide an attractive shade for a baby in any of the embodiments. It has a stand with an inexpensively made removable coupling for quick attachment.

The interchangeable components are made from inexpensive common construction materials which are non-toxic, hygienic yet comfortable and attractive. A particular advantage is the use of the same materials to make single dual or multiple side-by-side baby holding units with an absolute minimum parts inventory.

BRIEF DESCRIPTION OF THE DRAWINGS

FIG. 8 is a perspective view showing how a decorative cover may be supported over the baby supporting area by a simple connection to a transverse member between the ends of the side members resting on the floor;

FIG. 9 is a cross-section of the transverse member and simple connection on the line 9—9 of FIG. 8.

DETAILED DESCRIPTION

Figure 1:
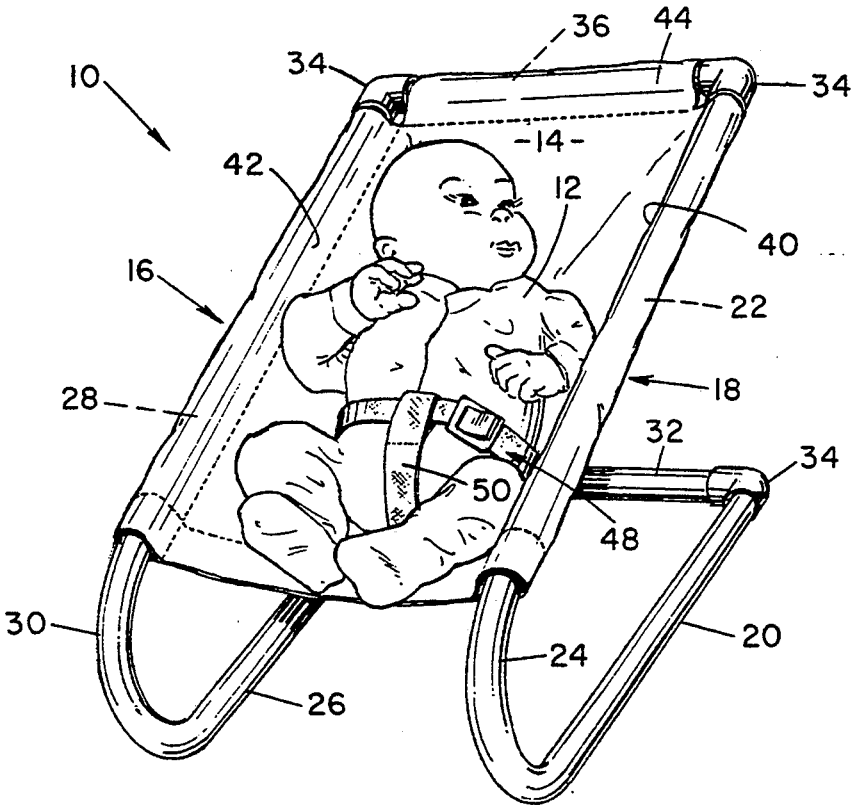
FIG. 1 is a perspective view of a single unit baby support seat showing a baby in position on the fabric support member.

A portable baby support seat is generally designated by the reference number 10 in FIG. 1. A baby 12 is shown in position on a fabric support member 14. The fabric support member is supported on a frame having spaced apart side members designated generally as 16 and 18. Side member 18 has a straight base leg 20, a straight support leg 22 and an intermediate reverse curved front leg 24. The support leg is supported by the base leg through the curved leg 24.

Similarly, side member 16 has a base leg 26, a generally straight support leg 28 and a reverse curved front leg 30 by which the upper support leg is supported from the base leg section. The base legs or underlegs 20,26 have distal ends which are connected to the opposite ends of a lower transverse leg 32. Connection means 34 connects the distal ends of the base leg 20 and the base leg 26 with opposite ends of the lower transverse leg 32, the connection means preferably being elbow-like connectors. Similarly, the distal ends of the support leg or overleg 22 and the support leg or overleg 28 are connected through connection means 34 to opposite ends of upper transverse leg 36.

Figure 3:
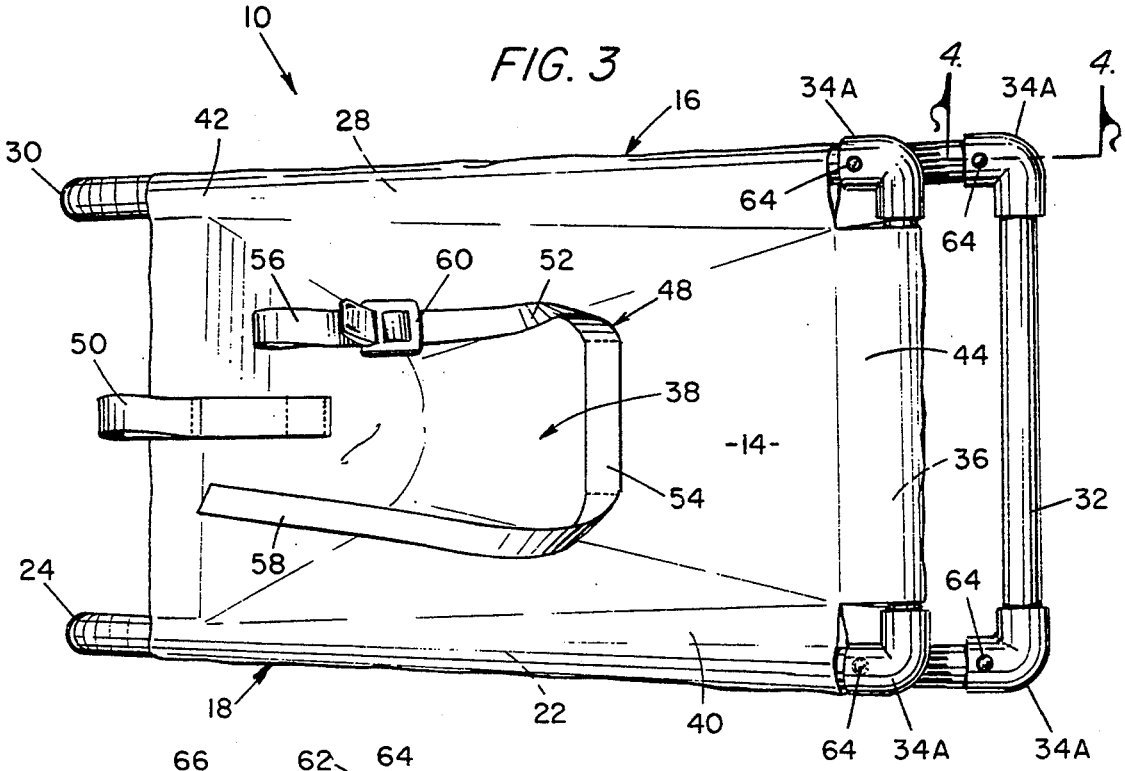
FIG. 3 is a plan view of the single unit of FIG. 2 showing elbow-like connectors at the extremities of the distal ends of the spaced apart side members.
Figure 4:
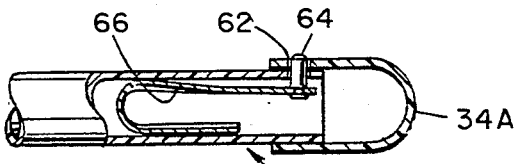
FIG. 4 is a cutaway cross-sectional view of a releasable pin-type connection at the end of a base leg or underleg of a single unit, which is connected to an elbow-like connector.

The fabric support member 14 has a central baby supporting area 38 where the baby is supported in FIG. 1 and generally indicated by the reference numeral 38 in FIG. 3. Fabric support member 14 has elongated side pocket means 40 on one side and elongated side pocket means 42 on the other side. These are located on either side of the baby supporting area 38 along the sides of fabric support member 14 and are intended for receiving support on each side from one of the generally straight support legs 22,28. In addition, fabric support member 14 has an upper pocket means 44 at the uppermost end of the fabric support member oriented generally transverse to the side pocket means, for receiving support from a generally transverse upper leg 36 of the frame. These pockets may be formed by folding over and sewing all or part of the side and upper peripheral edges of the support member 14 to form tube-like pockets. Dotted lines on the Figures represent seams formed by sewing.

Figure 2:
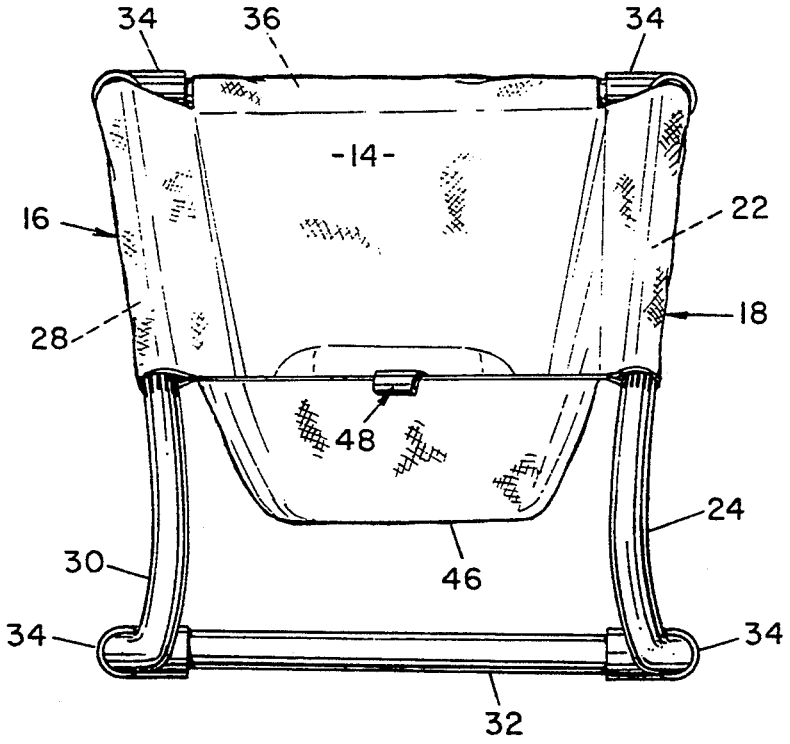
FIG. 2 is a front view in elevation of the single unit of FIG. 1 with the baby removed.
Figure 5:
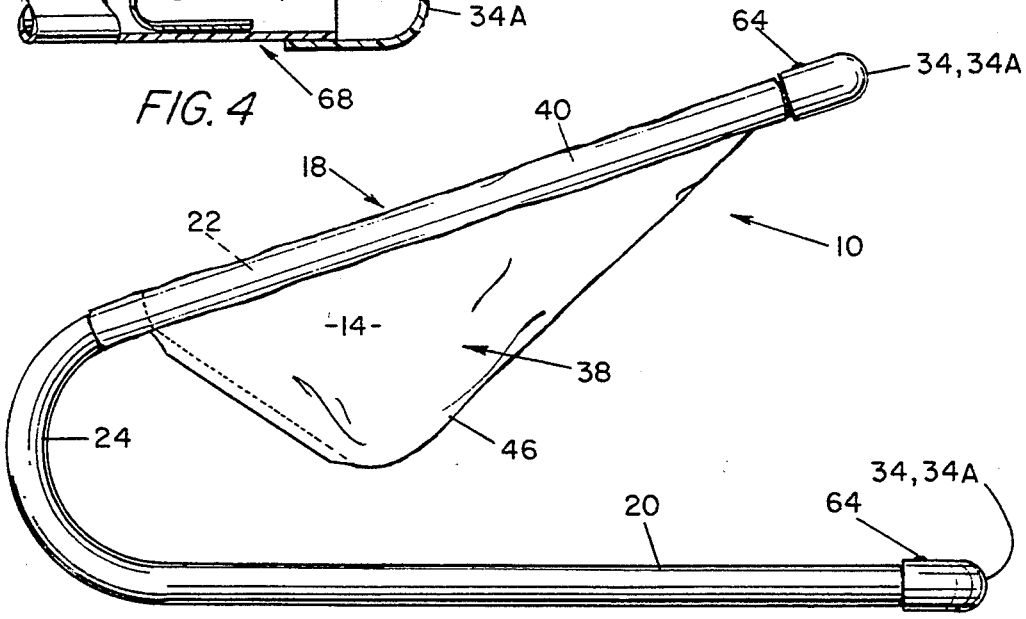
FIG. 5 is a side elevation of the unit of FIG. 4 showing a significant central pocket in the fabric support member somewhat exaggerated in depth.

FIG. 2 shows a front view which, together with FIG. 5, shows a significant central pocket 46 which is formed in the central baby supporting area 38 of the fabric support member 14. The significant central pocket is a pocket or depression in the central baby supporting area 38 which is formed by additional material in the fabric support member 14 which biasly supports a baby so that the baby tends to be retained in the central pocket area rather than off to one side of the center of the baby supporting area.

Finally, the baby may be secured in position by means of straps which function as securing means 48 to position the baby in the central pocket area. This is best seen in FIG. 3 where the securing means 48 comprises a crotch loop 50 and a strap member 52 having a central area 54 secured to the fabric panel 14, with a buckle end 56 and a free end 58. Buckle 60 is used to connect the buckled end to the free end as shown in FIG. 1. Various other types of buckles and strap means could be employed as a securing means to ensure that the baby does not fall out.

Figure 6:
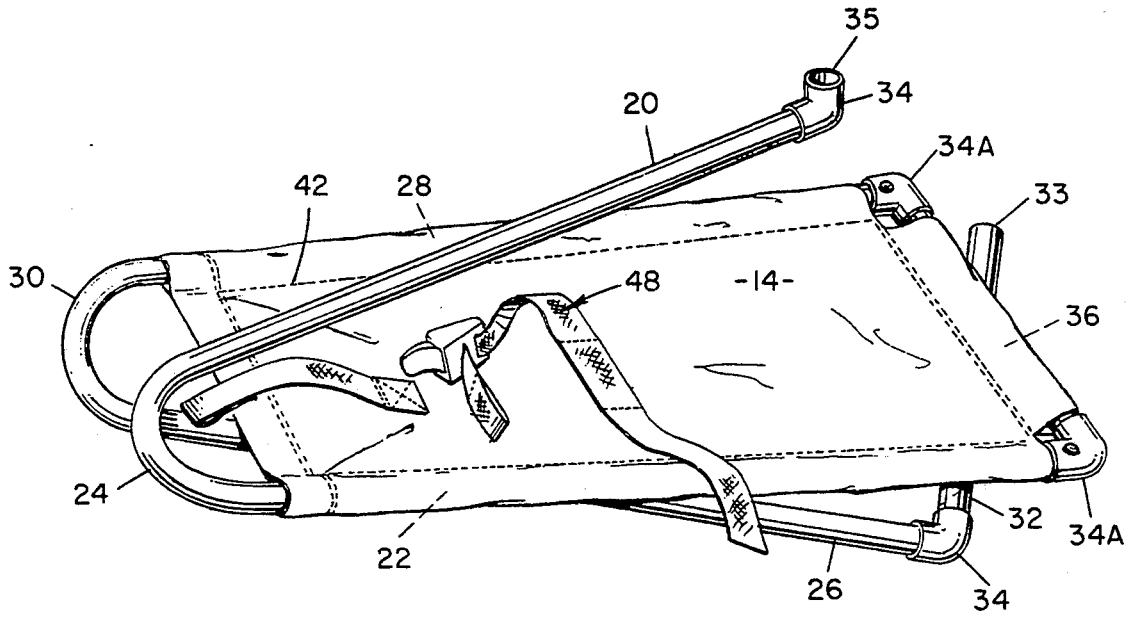
FIG. 6 is the unit of FIGS. 1–5 showing how the unit is folded flat by the complete disconnection of the distal end of one underleg or base leg from a lower transverse leg or transverse member and the rotation of the opposite distal ends of the side members without creating separate pieces.

An important aspect of the portable baby support seat of FIGS. 1-5 is shown in FIG. 6 where the seat is shown folded flat for being transported without having a multiplicity of individual pieces to gather up and put back together. The connection means 34 may engage the distal ends of the various leg portions of the support members in a friction fit which permits the distal ends to be loosened for rotation relative to the connection means 34 or disconnected completely. FIG. 6 shows that by completely disconnecting a distal end 33 of lower transverse leg 32 from the opening 35 of connection means 34, and by rotating the distal ends of the support members or overlegs 22 and 28 with respect to the modified connection means 34A in FIG. 6, the entire unit can be folded flat.

FIG. 6 illustrates that a combination of the connection means 34 or the modified connection means 34A may be used. FIG. 3 shows use of four of the elbow-like modified connection means 34A, best seen in cross-section in FIG. 4. They are simply elbow-like connections with an opening 62 for a pin member 64. Pin member 64 is supported by a spring member 66 which is frictionally or otherwise engaged within the distal end of a frame member represented generally by the reference numeral 68. It may be seen that by depressing the pin 64 below the level of the opening 62, the distal end 68 may be rotated relative to the connection means 34A to permit folding. Absent a conventional retention element which might be included, the distal end 68 may also be removed from the connector 34A. Modified connector member 34A could be modified further still by including an additional opening 62 for similar pins 62 located in the distal ends of upper and lower transverse members 32,36. Various combinations of connector 34 and modified connector 34A, as indicated in FIG. 5, may be used.

It is also evident that it is desirable to have the connector members 34,34A which engage the distal ends of the support legs or overlegs as best seen in FIG. 3, removable wherein the fabric support member 14 can be installed or removed on the support legs 22, 28 by sliding pockets 40,42 respectively over support legs 22, 28. It is also preferable to have the upper transverse member 36 removable from the pocket 44 so that the fabric member can be removed for washing separately from the frame itself. However, a particular advantage of the preferred fabric support member 14 is obtained if it be made from an open mesh scrim-like material with a non-absorbent, non-slip coating which does not absorb water. This makes it easy to clean and reuse right on the frame without drying and without any disassembly whatsoever. Alternately, it can be removed and machine washed as desired.

It might also be noted that it is possible to combine two of the portable baby support seats shown in FIGS. 1-6 by juxtaposing adjacently two of the units of FIG. 1 side by side along the side support members and providing releasable connections which hold the side member of one unit up against the side member of another unit. For example, this could be accomplished by straps around the respective curved portions 24 of one and 30 of the other with perhaps an additional connector around the baseleg 20 of one and the baseleg 26 of the other. The straps could also be releasably and removably connected between the fabric panels of two side-by-side units.

Figure 7:
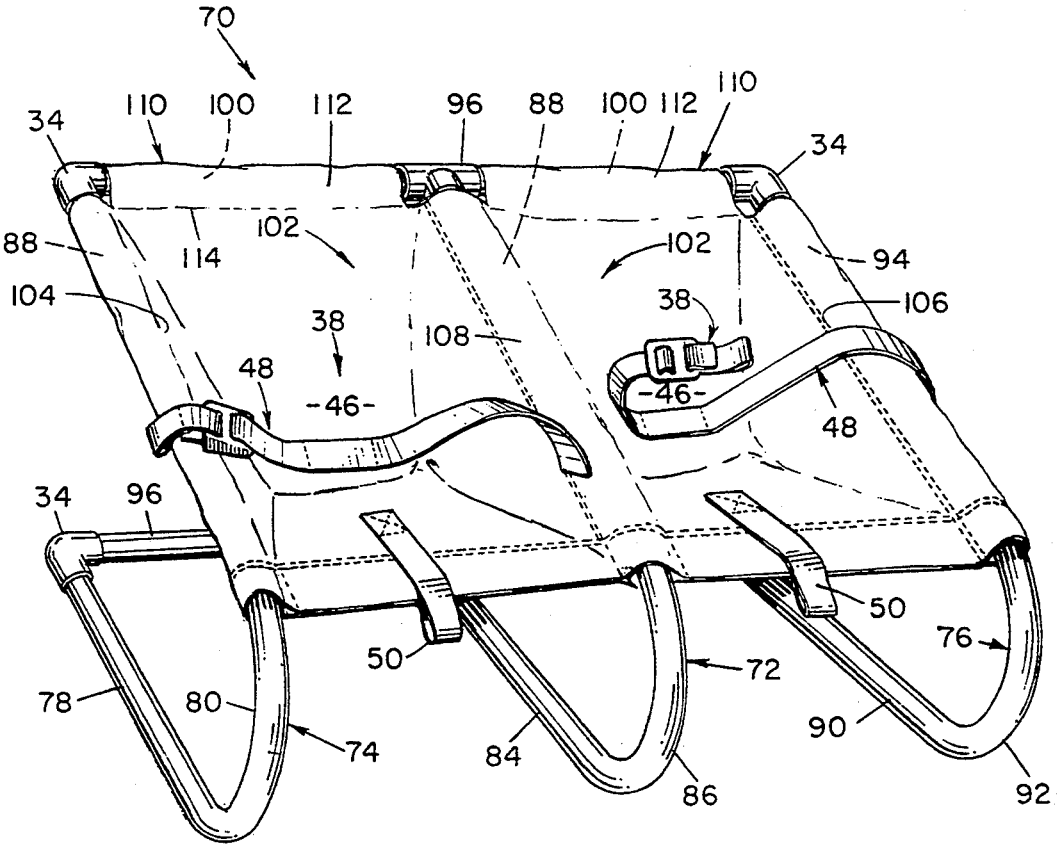
FIG. 7 is a perspective view of a portable dual baby support seat and a pair of side support members and a central support member in support of a fabric support member to create a dual seat for two babies.

An alternate embodiment is a portable dual baby support seat shown in FIG. 7. Although different nomenclature will be used in describing the dual baby support seat, it is to be understood that the basic elements are the same as used for the single seat embodiment. The dual baby seat of FIG. 7 is described generally by the reference numeral 70. Seat 70 has a frame having a central support member 72 positioned between a pair of spaced apart side members 74 and 76. Each of these frame support members 72, 74, 76 have an underleg and overleg connected by an intermediate curved leg portion and arranged for resting on a surface with the overlegs suspended over the respective underlegs of each frame support member. Side member 74 has an underleg 78, an intermediate curved leg 80, and an overleg 82. Central support member 72 has an underleg 84, an intermediate curved leg portion 86, and an overleg 88. Similarly, side support member 76 has an underleg 90, an intermediate curved leg 92, and an overleg 94. The frame underlegs of the support members have distal end portions connected to a backleg support member 96 extending from the central underleg transversely to either side and connected by connections 34 to the distal ends of the side support member base legs 78, 90 and by T-like connections 98 to the base leg 84 of the central support member. The T-like connection is like that seen at the upper portion of FIG. 7, but hidden under the fabric cover.

Similarly, the frame overlegs 82, 94 of the support members 74, 76 have distal end portions connected to an upper leg support member 100 extending from the central overleg transversely to either side and connected to the distal ends of the overlegs 82, 94 of the side support members. A distal end of central overleg 88 is preferably connected by a T-like member 98 as shown in FIG. 7. The upperleg support member 100 may be separated at T-749 like member 98 or be a continuous single piece extending to the extremities of both sides where it meets the connectors 34.

A fabric support member 102 having elongated side pocket means 104 on one side and 106 on the opposite side are designed for receiving support on each side from one overleg of a side support member. Elongated pocket means 104 receives support from overleg 82 and elongated pocket means 106 receives support from overleg 94. Fabric support member 102 also has an elongated central pocket means 108 for receiving support from overleg 88 of central support member 72.

The fabric support member 102 has upper support means 110 arranged at its top end on either side of the central pocket means 108 for receiving support from the upper leg support member 100 which extends transversely from either side of central overleg 88. Upper support means 110 may be an elongated pocket 112 formed by folding over a part of the fabric and sewing along a line 114. The other pocket means may be similarly formed.

The fabric support member further includes a pair of central baby supporting areas 38 centered on each side between the elongated central pocket means 108 and the elongated side pocket means 104, 106 for supporting a baby on the central baby supporting area when the fabric support member is mounted on the frame. The frame is adapted by selection of the frame material and geometry to flexibly provide gentle bouncing motion in response to the ordinary movements of at least one baby positioned on a baby supporting area 38 of the fabric support member 102 with the fabric support member being supported by the frame. A securing means 48 comprising the same strap system as described earlier may be used for each baby supporting area 38 for the purpose of securing a baby in position. The connections at the backleg support member 96 and the upperleg support member 100 at the distal ends of the frame members are rotatably releasable so that the central support member and the pair of spaced apart side support members can be folded into a flat orientation for being transported from place to place. By disconnecting the connections 34 at each side member and the connections 98 at the central support member, the fabric support member 102 can be removed from the frame by sliding it upwardly from the position shown in FIG. 7 away from the frame. The upper support member 100 can be disassociated from the fabric support member by sliding it out of the elongated pockets 112 so that the fabric support member 102 can be machine washed by itself. The central baby supporting area 38 may include the significant central pocket 46 for biasly supporting a baby in the central pocket area of each side of the dual baby support seat.

Figure 10:
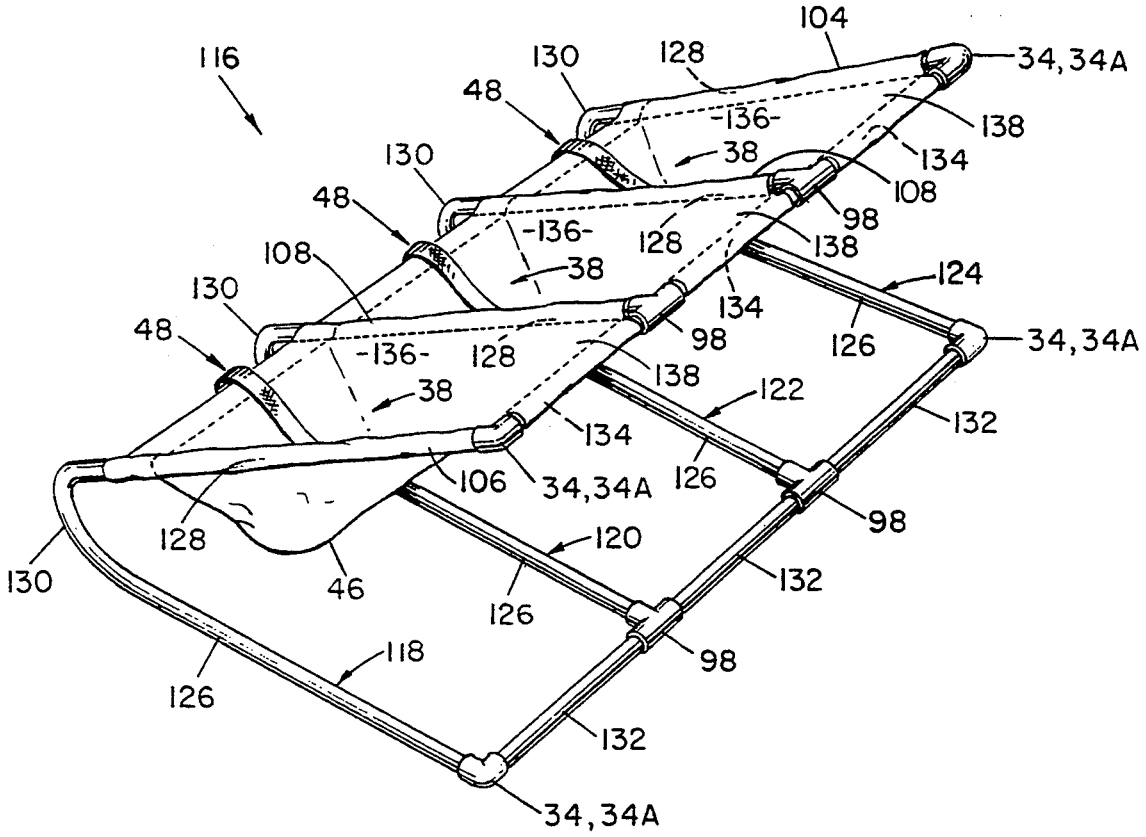
FIG. 10 is a perspective view of a multiple baby support seat showing two outside frame members and two inside frame members connected together to form a frame to support a plurality of unit fabric support covers, in unit position, to provide three individual baby supporting units in side-by-side orientation on a common frame, using the same common components as in the single units.

In a further embodiment, a multiple baby support seat is shown in FIG. 10. The multiple support seat is designated generally by the reference numeral 116. It is to be understood that although different nomenclature may be used, the unit of FIG. 10 may be made using the same common materials as were disclosed in the other two embodiments, namely, the single seat and the dual support seat.

In FIG. 10, a frame is formed from a plurality of spaced apart upright frame members in side-by-side arrangement comprising outside frame member 118, inside frame members 120 and 122, and outside frame member 124. Each of these frame members has a base leg 126 for resting on a surface, and a support leg 128 raised over the base legs while defining the edge of a baby holding unit supporting a unit fabric support cover, the support legs being supported through an intermediate curved leg 130, connected respectively, to each base leg. That is to say, the side frame member 118, for example, has a base leg 126, a support leg 128 raised over the base leg being supported by the base leg through the intermediate curved leg 130, all of which may be a continuous side member. The base legs 126 have distal ends which are connected in spaced apart orientation to one or more first transverse members 132 extending from one end outside frame member to the other end outside frame member and including connections, such as connections 98 at the spaced apart distal ends of the base legs 126 of the inside support members 120, 122. Elbow-like connectors 34, 34A may be employed at the distal ends of the base legs of the outside frame members where they are connected to the extreme outer ends of the one or more first transverse members 31, 32. It is easily seen that the members 132 may be separate individual members between adjacent base legs, or they could be a continuous length running from side to side.

The support legs 128 of spaced apart successive side-to-side outside, inside and outside support members 118, 120, 122, 124 define the edges of individual baby supporting units and have distal ends which are connected in spaced apart unit orientation by one or more second transverse members 134 extending from one outside frame member to the other outside frame member and including T-like connections 98 at the spaced apart distal ends of the support legs of the inside frame members. Second transverse members may be individual members or they could be a single length which extends from one extreme side of frame member 118 to the other extreme side of frame member 124. The distal ends of the support legs 128 of the outside frame members may be connected to the second transverse member by elbow-like connectors 34, 34A.

A plurality of unit fabric support covers 136, which may be joined together in a unitary fashion, are supported by the support legs of the frame members by means of elongated side pockets 104, 106 at the opposite ends and elongated central pockets 108, as previously described in connection with the dual baby support seat. Baby holding support units are defined between adjacent support members, each baby holding support unit having central baby supporting areas 38 as previously described. Baby supporting areas 38 may include a significant central pocket 46, only one of which can be seen clearly in FIG. 10. Each baby holding support unit may further be equipped with a securing means 48 comprising the same strap combination as best seen in FIG. 3.

The frame is made up of frame members which are adapted by selection of material and geometry to provide a gentle bouncing motion in response to natural movements of one or more babies being located in one or more of the baby holding units on the unit fabric support covers. The connections 34, 34A between the distal ends of the frame members 118, 124 and the connections 98 between the distal ends of the frame members 120, 122 and said one or more first and second transverse members, are disconnectable and reconnectable so that the frame may be disassembled and folded flat for transport.

In the multiple support seat, it is preferable that the interconnections between the base legs 126 and the one or more first transverse members 132 be disconnectable so that the frame members can be folded flat for transport. The connections at the distal ends of the support legs and the second transverse member are also preferably disconnectable so that the unit fabric support cover or covers can be disconnected for machine washing separate from the frame. However, the use of the preferred material makes it possible for washing to take place of the fabric support cover without disassembly. In any event, they need to be at least partially disconnectable and rotatable at the second transverse member so that the frame members can be rotated to lie flat on a surface.

In FIGS. 8 and 9, a decorative cover 140 may conveniently be removably affixed to any of the units, here shown with the single baby support seat 10. Decorative cover 140 is supported on a partially curved stand 142 which has a connector 144 at one end for connection to the cover 140 and a removable connector 146 at the opposite end for connection to a lower transverse leg or a backleg support member or one or more first transverse member of any of the embodiments disclosed in the application. A cross-section of the connector 146 is seen in FIG. 9 which shows that it has an arcuate surface 148 which is greater than half the circumferential diameter of the outside of transverse leg 32. It may be formed by cutting off the bottom portion of a T-like connector 98 to make an extremely cost effective connector. It has a perpendicular collar 145 to which the end of the stand 142 is frictionally connected. Connector 146 frictionally engages the transverse member 32 when it is pushed into place with the arcuate surface 148 in contact with the outside surface of transverse member 32. It may easily be removed by pulling it to one side and provides adjustment frontwardly and rearwardly by rotating the stand 142 backwards or forwards. Decorative cover 140 serves as a sunshade so that the unit may be used outside. Stand 142 may also be used to hang a toy over a baby placed in the unit.

In the best mode, the portable baby support seat, dual portable baby support seat, and multiple baby support seat are all made from common, ordinarily available materials and use common parts so that single, dual or multiple units are easily made up from a minimum amount of component inventory. The units are especially advantageous for the harried parents of twins or triplets, or even quads. The interchangeability of parts makes it possible to construct any number of side-by-side units.

The simplicity of the unit and the use of commonly available materials makes for extremely inexpensive construction. The frame is preferably made from commonly available polyvinyl chloride (PVC) water pipe, which is non-toxic, light in weight, and easily heat-formed as a single piece. It is important that the size of the pipe and the pipe material for the frame members be selected so that a gentle bouncing action may be created by the normal movements of the baby. This action can be enhanced, for example, by flattening the curved intermediate leg, such as legs 24, 80 or 130 during the heat forming process. Alternately, the frame members could be made from separate pieces which might have different characteristics. For example, in FIG. 5, portions 20, 22 and 24 might be made as separate pieces joined together and some of them could have different modulus of elasticity. It might be noted that the bouncing action is created primarily by flexing at the reversed curved front legs 24, 30 of the embodiment shown in FIG. 1, but also by slight bending of the base legs or underlegs 20, 26 toward each other at the front due to the weight of the baby pulling on the fabric cover in a transverse side-to-side direction which tends to bring the intermediate curved legs 24, 30 closer together or farther away, with the opposite ends of the base or underlegs being rigidly fixed in position through the connection of the lower transverse leg 32 and the elbow-like connectors 34. Such movement is slight, but it tends to enhance the "bounciness" of the unit as a whole.

The elbow-like connectors 34, 34A and the T-like connectors 98 are preferably made of the same PVC material, although it may be formed from other plastic materials. They are advantageously simple elbows and T's which frictionally engage the distal ends to make a connection and are removable or partly removable and rotatable to permit disassembly or holding. By partially disconnecting the distal ends of the frame members, the frame members can be rotated without coming loose from the connectors; thus, the various parts can be maintained in connection with each other while the unit is flat and transported without losing elements and without the necessity for bolts or screw fasteners. At the same time, the preferable friction fit connectors can be entirely removed if it is desirable to do so, as, for example, when the fabric support cover is to be removed for washing.

The fabric support cover 14, 102, 136 is preferably made from a single layer of mesh, polyester fabric which is coated. An open mesh fabric having an 18×15 thread per inch polyester scrim base with a respective denier of 600×840 coated with PVC vinyl has been used successfully. This fabric has a total thickness of about 0.016" and weighs about 9 ounces per square yard. The PVC coating acts as a non-slip coating which helps to keep the baby from slipping out of the baby supporting seat. The open mesh allows the fabric to breathe so that the baby is not overheated in hot weather. A single layer is strong enough, yet allows air to flow.

A particular advantage of the preferred fabric support member or cover is that in addition to being non-slip, the coated fabric is waterproof and does not absorb water. This has several aspects, the first being that it does not absorb body fluids or stain as normal fabrics do. Of greater importance is the fact that the unit can easily be washed or scrubbed with a brush in a tub, or even taken outdoors and hosed down without becoming wet or requiring lengthy drying periods. Any excess water can be shaken off or towel dried, and the unit is immediately ready to use again without discomforting baby. Thus, it is possible to leave the unit assembled and never disassemble it since the cover can be washed while the unit is on the frame. Yet the cover is easily removed by removing the several connectors at the top end if the user prefers to machine wash it.

The single unit is very light in weight, in one embodiment weighing just about 3 pounds. The preferred material resists chipping, peeling, or cracking, and is available in attractive white without the necessity for painting. The unit is comfortable for the baby because of the springiness and the fact that the baby does not come into contact with any hard surfaces, and thus does not need any special padding to protect it.

Although it is preferable to provide separate dual fabric support members or multiple fabric support members for the dual or multiple embodiment, it is also possible to connect in side-by-side arrangement two or more of the fabric support members shown in the embodiment of FIG. 1. This might be done by removing part of the elongated side pocket from one of the units, for example, in a dual unit in sewing it or otherwise joining it to form the elongated central pocket 108. It is preferable that the support leg or overleg be angled upwardly so that the baby's head is elevated above its feet. Although the elongated side pocket and upper pocket means are shown as overlapped continuous tube-like pockets to slide over the support legs, they could be made from spaced apart looped portions around the tubular members and may even be equipped with disconnectable snap fasteners to make the fabric support cover easier to remove.

Although preferred embodiments of the present invention have been described here in detail, those skilled in the art will recognize the various substitutions and modifications which may be made to the specific structures by methods of fabrication without departing from the scope and spirit of the invention as recited in the claims.

I claim:

1. Portable baby support seat comprising:

a frame having a pair of upright spaced apart side members, each side member having a base leg, an intermediate reverse curved front leg and a generally straight support leg supported by the base leg through the reverse curved leg, wherein the generally straight support leg of each side member is angled upwardly with respect to a support surface upon which the base legs may be placed;

the frame including a lower transverse leg having opposite ends and an upper transverse leg having opposite ends;

the base leg of each spaced apart side member having a distal end extending rearwardly away from its intermediate reverse curved front leg, the distal end of each base leg being releasably connected to an opposite end of said lower transverse leg of the frame, the base legs and the lower transverse leg being designed for placement on a surface to provide a sturdy base for the seat;

the generally straight support leg of each upright spaced apart side member being angled gradually upwardly and rearwardly over its corresponding base leg, to terminate in a distal end;

a fabric support member having an uppermost end and a central baby supporting area below the uppermost end, the fabric support member having elongated side pocket means on either side of the central baby support area for receiving support from a generally straight support leg of one of the upright spaced apart side members on each side, the fabric support member having an upper pocket means at the uppermost end of the fabric support member oriented generally transverse to the side pocket means, for receiving support from said upper transverse leg of the frame;

said distal end of each said generally straight support legs being releasably connected to one of the opposite ends of the upper transverse leg, to complete the frame;

wherein the upper pocket means of the fabric support member is supported by the transverse upper leg of the frame and the side pockets of the fabric support member are each supported by one of the generally straight support legs of the frame to secure the central baby supporting area of the fabric support member on the frame in a gradually upwardly angled inclination;

the frame being formed from flexibly bendable lightweight tubing adapted to flexibly provide a gentle bouncing motion in response to the ordinary movements of a baby when a baby is located on the baby supporting area of the fabric support member mounted on the frame; and the frame is foldable to a flat orientation by releasing the distal ends of the support legs from the upper transverse leg and releasing the distal ends of the base legs from the lower transverse leg.

2. The portable baby support seat of claim 1 wherein said fabric support member is made of a single layer of an open mesh non-absorbent material.

3. The portable baby support of claim 2 wherein the fabric support member has a non-slip coating.

4. The portable baby support seat of claim 2 wherein said fabric support member is equipped with straps to secure a baby in position at the central baby supporting area.

5. Portable baby support seat comprising:

a frame having a pair of spaced apart side members, each side member having a base leg, an intermediate reverse curved front leg and a generally straight support leg supported by the base leg through the reverse curved leg wherein the generally straight legs of said side members are upwardly angled with respect to a surface on which the frame may be placed with the base leg of the side members in contact with said surface;

the frame including a lower transverse leg having opposite ends and an upper transverse leg having opposing ends;

the base leg of each spaced apart side member having a distal end extending rearwardly away from the intermediate reverse curved front leg of said side member and a releasable connector on the distal end of each base leg, adapted for frictionally engaging and disengaging one end of the lower transverse leg of the frame, said distal end of each base leg and one end of the lower transverse leg being releasably connected with said connectors and suitable for placement on said surface to provide a sturdy base for the seat;

the generally straight support leg of each spaced apart side member is upwardly angled from the intermediate reverse curved front legs to terminate in an end having a releasable connector adapted for frictionally engaging and disengaging one end of the upper transverse leg, the end of each generally straight support leg and one end of the upper transverse leg thus being releasably connected to complete the frame;

a fabric support member having an uppermost end and a central baby supporting area below the uppermost end, the fabric support member having elongated side pocket means on either side of the central baby supporting area, for receiving support from one of the generally straight support legs of the frame, the fabric support member having an upper pocket means at the uppermost end of the fabric support member oriented generally transversely to the side pocket means, for receiving support from the upper transverse leg of the frame;

the upper pocket means of the fabric support member being supported by the upper transverse leg of the frame and the elongated side pocket means of the fabric support member each being supported by one of the generally straight support legs of the frame to secure the central baby supporting area of the fabric support member on the frame;

the frame being formed from flexibly bendable lightweight tubing adapted to flexibly provide a gentle bouncing motion in response to the ordinary movements of a baby when a baby is located on the baby supporting area of the fabric support member mounted on the frame; and wherein the lower transverse leg and the upper transverse leg are releasable from the spaced apart side members for folding and the transverse upper leg may be removed from the spaced apart side members and the fabric support member in order to permit slipping off the fabric support member from the spaced apart side members of the frame for the purpose of washing and cleaning.

6. The portable baby support seat of claim 5 wherein said releasable connectors at the ends of the generally straight support legs and at the distal ends of the base legs are elbow shaped connectors each used to engage and disengage an end of the respective upper and lower transverse legs, the elbow shaped connectors having at least one means for disengageable and reengageable connection sufficient to allow flat folding.

7. The portable baby seat of claim 5 wherein said flexibly bendable lightweight tubing is formed from hollow plastic.

8. The portable baby seat of claim 5 in which the frame and said connectors are made from lightweight plastic.

9. The portable baby support seat of claim 8 including a removable stand member supported on the frame, the stand member including a decorative cover being supported over the baby supporting area.

10. The portable baby support seat of claim 9 wherein said removable stand member is frictionally and removably engageable by means of a removable connector.

11. The portable baby support seat of claim 10 wherein said support stand is formed from the same lightweight plastic tubing as the frame side members, said stand member being supported by a removable connector formed from a T-shaped connector with a portion cut-away so that the T-shaped connector will slip over and frictionally engage the outside diameter of a part of said frame.

12. The portable baby support seat of claim 5 wherein the fabric support member is formed with a significant central pocket in the central baby supporting area for biasly supporting a baby in the central pocket.

13. The portable baby support seat of claim 12 wherein said fabric support member is equipped with straps to secure a baby in position in the central pocket.

14. A portable takedown baby support having a front and rear, for supporting a baby on its back with its head partially raised above its feet, comprising:

a frame formed from a duality of spaced apart upright frame members in side-by-side arrangement and having a lower transverse leg and an upper transverse leg extending between said spaced apart upright frame members;

each of said frame members having a base leg for supporting the frame on a surface, an intermediate curved leg and a support leg, each base leg being connected to the support leg through the intermediate curved leg at the front of the frame and having a distal end extending rearwardly away from the intermediate curved leg;

the support leg of each frame member being angled upwardly over its base leg and extending toward the rear of the frame to terminate at a distal end;

the support legs of the dual spaced apart upright frame members defining the sides of a baby holding unit and supporting a unit fabric support cover having a width extending between said support legs, said cover being supported by a support leg on each side by means for securing said unit fabric support cover in proper orientation on said support legs in order to support a baby on the unit fabric support cover;

the support legs of each of the dual frame members and the entire unit fabric support cover being gradually angled upwardly from the base legs of the frame members, at a sufficient angle so that when the base legs are resting on a surface, the baby holding unit comprising the unit fabric support cover will elevate a baby's head higher than its feet when a baby is placed to lie on its back on the unit fabric support cover;

each of the distal ends of the base legs being connected by connection means to one end of said lower transverse leg of the frame and each of the distal ends of the support legs being connected by connection means to one end of said upper transverse leg of the frame;

at least one of said connection means between a base leg and the lower transverse leg being disconnectable to free one of the base legs from connection to the lower transverse leg and the other of said connection means being rotatably disengageable by loosening so that said frame members are foldable by rotating toward each other to a flat orientation without removing said other of said connection means from the frame;

said frame being adapted to flexibly provide a gentle bouncing motion in response to natural movements of a baby placed on the fabric support cover of the baby holding unit.

15. The portable takedown baby support seat of claim 14 wherein the unit fabric support cover comprises a layer of open mesh material with a non-absorbent, non-skid surface.

16. The portable takedown baby support seat of claim 15 wherein said fabric support cover is formed with a significant central pocket in the central portion of the baby holding unit for biasly supporting a baby in the significant central pocket area.

17. The portable takedown baby support seat of claim 16 wherein said upper transverse leg is removably disconnectable from said support legs and from said fabric support cover so that the cover may be removed for washing and cleaning.

18. The portable takedown baby support seat of claim 17 wherein said means for securing the unit fabric support cover to the support legs comprise loop portions of the fabric support cover to hold it in place upon said frame.

19. The portable takedown baby support seat of claim 18 wherein said frame members are formed from lightweight, hollow plastic tubing.

20. The portable takedown baby support seat of claim 19 wherein said baby holding unit includes strap means for securing a baby in supported position on said fabric support cover.

* * * * *